US005839347A

United States Patent [19]

Nomura et al.

[11] Patent Number: 5,839,347

[45] Date of Patent: Nov. 24, 1998

[54] WOBBLE PLATE COMPRESSOR WITH SWASH PLATE GUIDE MEMBER

[75] Inventors: Hiroshi Nomura; Kazuo Eitai; Minoru Kanaizuka; Hiroyuki Ishida, all of Saitama-ken, Japan

[73] Assignee: Zexel Corporation, Tokyo, Japan

[21] Appl. No.: 562,931

[22] Filed: Nov. 27, 1995

[30] Foreign Application Priority Data

Dec. 2, 1994 [JP] Japan ..... 6-329375

[51] Int. Cl.[6] ..... F04B 25/04

[52] U.S. Cl. ..... 92/12.2; 74/60

[58] Field of Search ..... 92/12.2, 57, 71; 91/505, 506; 74/60

[56] References Cited

U.S. PATENT DOCUMENTS 4,712,982 12/1987 Inagaki et al. ..... 92/12.2 X
4,745,814 5/1988 Miller et al. ..... 74/60
4,776,259 10/1988 Takai ..... 92/71
4,801,248 1/1989 Tojo et al. ..... 92/12.2 X
4,852,418 8/1989 Armstrong ..... 74/60
4,875,834 10/1989 Higuchi et al. ..... 74/60 X
5,140,903 8/1992 Terauchi ..... 92/71 X

*Primary Examiner*—John E. Ryznic
*Attorney, Agent, or Firm*—Frishauf, Holtz, Goodman, Langer & Chick,P.C.

[57] ABSTRACT

A guide member of a wobble plate compressor is slidably mounted in an inner wall surface of a housing of the wobble plate compressor. The guide member comprises a guide part having a U-shaped cross-section and defining a linear guide groove therein into which is slidably inserted a rotation-preventing member rigidly mounted on the wobble plate, and a pair of half cylinder shaped sliding parts mounted on opposite sides of the guide part for sliding in the inner wall surface of the housing. The inner surface of the guide member is hardened by surface treatment.

9 Claims, 7 Drawing Sheets

WOBBLE PLATE COMPRESSOR WITH SWASH PLATE GUIDE MEMBER

BACKGROUND OF THE INVENTION

1. Field of the Invention

This invention relates o a wobble plate compressor, and more particularly to a wobble plate compressor which is capable of reducing the manufacturing cost of a guide member into which a slipper is inserted for preventing circumferential movement of a wobble plate about a drive shaft of the compressor.

2. Description of the Prior Art

FIG. 9 shows the whole arrangement of a conventional wobble plate compressor in cross-section. FIG. 10 shows the interior of a front head viewed from a cylinder block side. FIG. 11 is a cross-sectional view of the front head taken on line D—D of FIG. 10.

As shown in FIG. 9, a shaft 105 has a thrust flange 140 rigidly fitted thereon, and a drive hub 141 rotatably mounted thereon via a hinge ball 109 which is slidable along the shaft 105. One end of the thrust flange 140 and one end of the drive hub 141 are connected to each other by a link arm 142, whereby the rotation of the shaft 105 is transmitted from the thrust flange 140 to the drive hub 141.

A wobble plate 110 has a central hole 110*a* formed therethrough into which a boss 143 of the drive hub 141 is inserted. The boss 143 has a thread formed around the outer periphery of a front end portion thereof, on which is screwed a nut 134 via a balance weight 130 which is in an annular form. Thrust bearings 128, 129 are interposed between the balance weight 130 and the wobble plate 110, and between the wobble plate 110 and the drive hub 141. One ball-shaped end 111*a* of a connecting rod 111 is linked to the wobble plate 110, while the other ball-shaped end of the same is linked to a piston 107.

The wobble plate 110 has a hole 110*b* radially extending from a central portion to the outer end, into which is inserted a restraint pin 135. The restraint pin 135 is caulked to the wobble plate 110. The restraint pin 135 has a slipper 136 mounted on a head thereof; and the slipper 136 is slidably inserted in a linear guide groove 151 of a guide member 150 (see FIG. 7) fitted in a mounting groove 104*a* formed in an inner wall surface of the front head 104.

FIG. 7 shows the guide member in perspective. FIG. 8A shows an end face of the guide member. FIG. 8B is a cross-sectional view of the guide member taken on line C—C of FIG. 8A. The guide member 150 is constituted by a body 152 having a cylindrical shape, with the body 152 being formed with the linear guide groove 151 extending along a longitudinal axis thereof. The guide member 150 is mounted in the mounting groove 104*a* in the inner wall surface of the front head 104 such that it is rotatable, by sliding, about its axis extending in parallel with the axis of the shaft 105, with the linear guide groove 151 extending in parallel with the shaft 105. The linear guide groove 151 has surfaces thereof subjected to nitriding treatment for smooth sliding of the slipper 136 thereon. Further, the body 152 has each side wall formed with a relief 152*a* at an open end face at one end of the body 152 to avoid interference with a rotation sensor, not shown.

With rotation of the shaft 105, the thrust flange 140 and the drive hub 141 rotate in unison therewith, whereby as the drive hub 141 rotates, the wobble plate 110 performs wobbling motion about the hinge ball 109. The wobbling motion of the wobble plate 110 is transmitted via the connecting rod 111 to the piston 107, thereby transforming the wobbling motion of the wobble plate 110 into a linear reciprocating motion of the piston 107. Since the slipper 136 mounted on the head of the restraint pin 135 is inserted into the linear guide groove 151 of the guide member 150, the rotation of the wobble plate 110 about the drive shaft 105 is prevented.

In the wobble plate compressor, as pressure within a crank case 108 decreases, the inclination angle of the wobble plate 110 increases as shown in FIG. 9, which brings the piston 107 to its maximum stroke, whereby the compressor is placed into the maximum delivery quantity condition.

On the other hand, as the pressure within the crank case 108 increases, the inclination angle of the wobble plate 110 decreases, and one end of the drive hub 141 becomes away from the thrust flange 140, which brings the piston 107 to its minimum stroke, whereby the compressor is placed into the minimum delivery quantity condition.

When the compressor is operating in the maximum delivery quantity condition, the slipper 136 largely sides within the linear guide groove 151.

Unless the inner wall surfaces of the linear guide groove 151 and the slipper 136 are properly spaced, there arises much noise. Therefore, the linear guide groove 151 should have a high accuracy in respect of its width or distance between opposed inner wall surfaces.

Further, if the slipper 136 is brought into line contact with an inner wall surface of the linear guide groove 151, surface pressure of the contacting portion increases to cause wear thereof. To avoid this inconvenience, the size of width of the bottom of the linear guide groove 151 is made slightly larger than that of the width of an entrance of the linear guide groove 151, while taking the inclination of the slippery 136 relative to the inner wall surface of the linear guide groove 151 into account, whereby it is made possible for the slipper 136 to be brought into surface contact with the inner wall surface of the linear guide groove 151. Further, the linear guide groove 151 and the slipper 136 are subjected to nitriding treatment to suppress wear thereof. However, such surface treatment causes undesired variation in the dimensions of the members, which can result in occurrence of noise if the wall surface of the linear guide groove 151 and the slipper 136 are spaced larger than they should be. On the other hand, there can result dragging or wear of these associated members if they are spaced smaller than they should be. Therefore, high machining accuracy is required of the guide member of conventional wobble plate compressors, which is a factor causing an increased manufacturing cost of the compressors.

SUMMARY OF THE INVENTION

It is an object of the invention to provide a wobble plate compressor having a guide member which guides a rotation-preventing member mounted on a wobble plate, and can be machined with ease.

To attain the above object, the invention provides a wobble plate compressor including a housing, a drive shaft, a wobble plate mounted on the drive shaft for performing wobbling motion according to rotation of the drive shaft, a guide member slidably mounted in an inner wall surface of the housing such that the guide member is rotatable about an axis parallel to the drive shaft, the guide member being formed with a linear guide groove extending in parallel with the drive shaft, and a rotation-preventing member rigidly mounted on the wobble plate and slidably inserted into the linear guide groove of the guide member for preventing rotation of the wobble plate.

The wobble plate compressor according to the invention is characterized in that the guide member comprises:

guide means having a U-shaped cross-section and defining the linear guide groove therein; and a pair of sliding means mounted on opposite sides of the guide means for sliding in the inner wall surface of the housing.

According to the wobble plate compressor of the invention, it is possible to prepare several forms of sliding means having different values of a thickness in advance, and then select a pair of suitable ones therefrom. The elastic deformation of the guide means occurring when the guide member is mounted in the inner wall surface of the housing changes the width of an entrance of the linear guide groove in a manner corresponding to the thickness of each of the pair of sliding means, whereby space between the inner wall surfaces of the guide means and the rotation-preventing member can be adjusted to the optimum value. This makes it possible to obtain accurate dimensions of the guide member with ease, which contributes to reduction of manufacturing cost of the compressor.

Preferably, the guide means is formed by pressing a plate into a shape having the U-shaped cross-section.

Preferably, the guide means has side walls defining the linear guide groove therebetween, the side walls each having an extension portion integrally formed therewith such that the extension portion extends toward the drive shaft according to a path of the rotation-preventing member.

According to this preferred embodiment, the guide means has side walls each having an extension portion integrally formed therewith such that the extension portion extends toward the drive shaft, in an state of the guide member being mounted in the inner wall surface of the housing, according to a path of the rotation-preventing member. Therefore, the inner wall surfaces of the guide means and the rotation-preventing member are prevented from being in line contact with each other but are brought into surface contact with each other, which improves sliding characteristics of the rotation-preventing member on the guide means.

Preferably, the guide means has a surface with a surface hardness enhanced by surface treatment.

According to this preferred embodiment, the guide means alone is subjected to surface treatment. Therefore, it is possible to reduce the cost of the surface treatment.

Preferably, each of the pair of sliding means has a shape similar to that of a half cylinder.

Further preferably, each of the sidewalls of the guide means has an outer surface thereof formed with projections, and each of the pair of sliding means has an inner surface thereof formed with holes, with the holes being fitted on the projections on the outer surface of the each of the side walls of the guide means, whereby the pair of sliding means are fixed to the side walls of the guide means, respectively.

The above and other objects, features and advantages of the present invention will become more apparent from the following description taken in conjunction with the accompanying drawings.

DETAILED DESCRIPTION OF THE PREFERRED EMBODIMENTS

Next, the invention will now be described in detail with reference to drawings showing preferred embodiments thereof.

Figure 3:
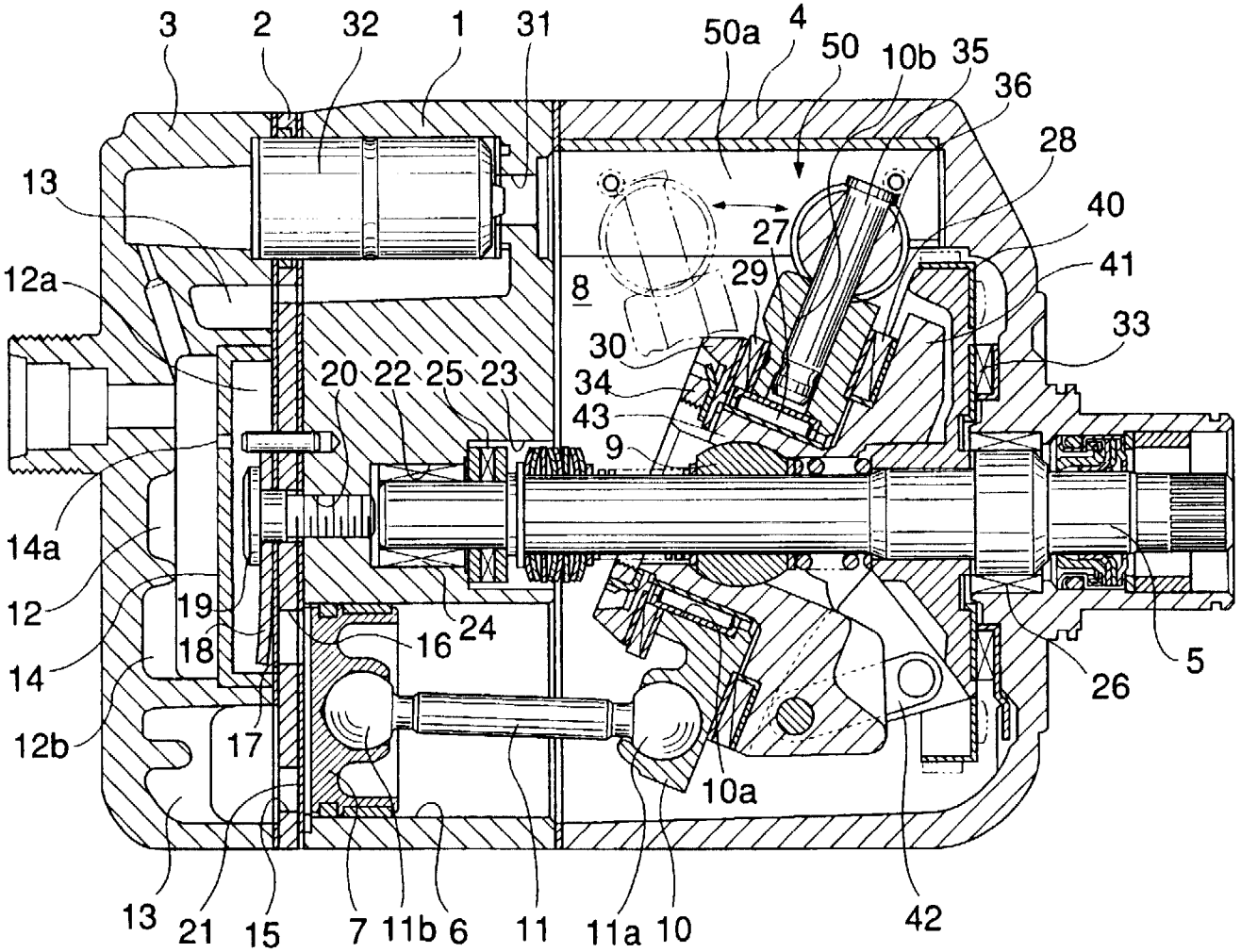
FIG. 3 is a longitudinal cross-sectional view showing the whole arrangement of the wobble plate compressor according to the one embodiment of the invention.

FIG. 3 shows a wobble plate compressor along the longitudinal axis thereof according to one embodiment of the invention, which is comprised of a cylinder block 1, a rear head 3 connected to one end face of the cylinder block 1 via a valve plate 2, and a front head (housing) 4 connected to the other end face of the cylinder block 1.

The cylinder block 1 is formed with a plurality of cylinder bores 6 at predetermined space intervals in the circumferential direction about a shaft (drive shaft) 5. Each cylinder bore 6 has a piston 7 slidably received therein.

The front head 4 has a crank case 8 formed therein, in which is received a wobble plate 10 for wobbling motion about a hinge ball 9 in a manner linked to the rotation of the shaft 5.

The rear head 3 is formed therein with a delivery chamber 12 and a suction chamber 13 formed around the delivery chamber 12. The delivery chamber 12 is divided by a partition 14 into delivery spaces **12*a*, 12*b* which are communicated with each other via at least one restriction hole 14*a***.

The valve plate 2 is formed with delivery ports 16 which provides communication between respective cylinder bores 6 and the delivery chamber **12*a*, and suction ports 15 which provides communication between respective cylinder bores 6 with the delivery chamber 13, at predetermine space intervals in the circumferential direction. Each delivery port 16 is opened and closed by a delivery valve 17 which is fixed to an end face of the valve plate 2 on the rear head side together with a valve retainer 18 by a bolt 19. The bolt 19 is screwed into a screw hole 20 formed in the cylinder block 1 via a central hole 2*a* formed through the valve plate 2. Each suction port 15 is opened and closed by a suction valve 21 which is arranged between the valve plate 2 and the cylinder block 1**.

A screw hole 20, a small diameter hole 22, and a large diameter hole 23 are formed in the center of the cylinder block 1 along the longitudinal axis thereof such that they are communicated with each other. In the small diameter hole 22, a radial bearing 24 is received, and in the large diameter hole 23, a thrust bearing 25 is received. The radial bearing 24 and the thrust bearing 25 support a rear side end of the shaft 5, and a radial bearing 26 arranged in the front head 4 supports the front side end of the shaft 5.

Further, the cylinder block 1 is formed with a communication passage 31 communicating the suction chamber 13 with the crank case 8. A pressure control valve 32 is provided in an intermediate part of the communication passage 31 for controlling pressure within the suction chamber 13 and the pressure within the crank case 8.

Further, the shaft 5 has a thrust flange 40 rigidly fitted thereon, and a drive hub 41 rotatively mounted thereon via the hinge ball 9. One end of the thrust flange 40 and one end of the drive hub 41 are connected to each other by a link arm 42, whereby the rotation of the shaft 5 is transmitted from the thrust flange 40 to the drive hub 41.

The wobble plate 10 has a central hole 10*a* formed therethrough into which a boss 43 of the drive hub 41 is inserted. The boss 43 has a thread formed around the outer periphery of a front end portion thereof, on which is screwed a nut 34 via a balance weight 30 which is in an annular form. Thrust bearings 28, 29 are interposed between the balance weight 30 and the wobble plate 10, and between the wobble plate 10 and the drive hub 41. One ball-shaped end 11*a* of a connecting rod 11 is linked to the wobble plate 10 such that the ball-shaped end 11*a* is rotatable about its center, while the other ball-shaped end of the same is linked to the piston 7.

The wobble plate 10 has a hole 10b radially extending from a central portion thereof to the outer end, into which is inserted a restraint pin 35. The restraint pin 35 is caulked to the wobble plate 10. The restraint pin 35 has a slipper 36 mounted on a head thereof, and the slipper 36 is slidably inserted in a linear guide groove 50*a* of a guide member 50, described in detail hereinbelow. The restraint pin 35 and the slipper 36 form a rotation-preventing member.

Figure 1:
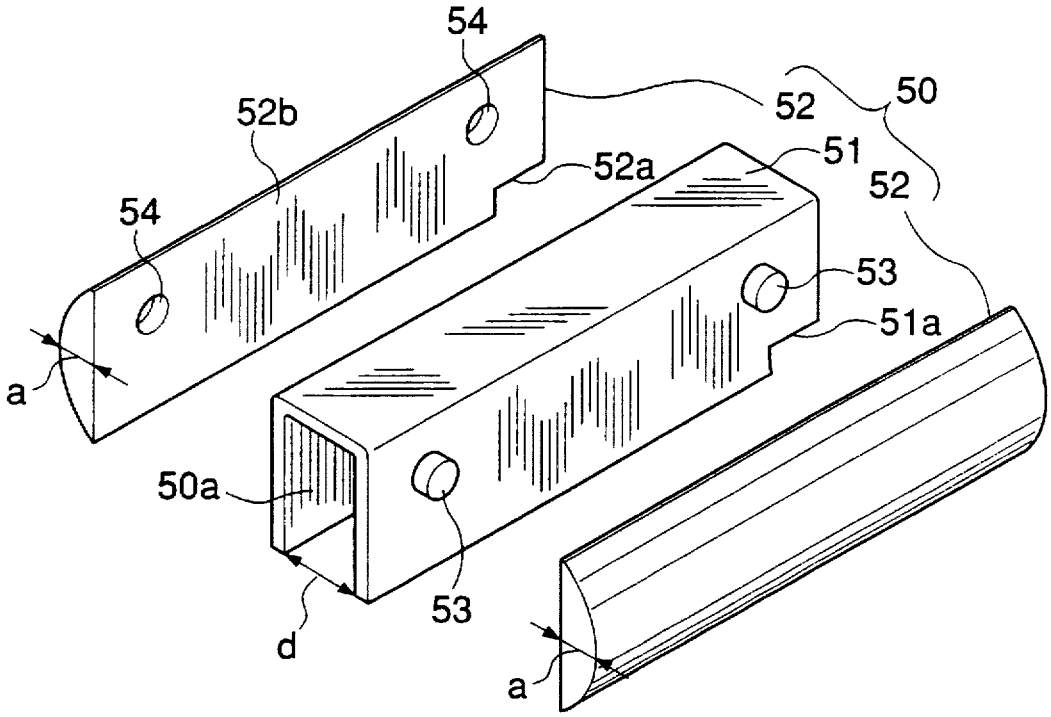
FIG. 1 is an exploded perspective view of a guide member used in a wobble plate compressor according to one embodiment of the invention.
Figures 2A, 2B:
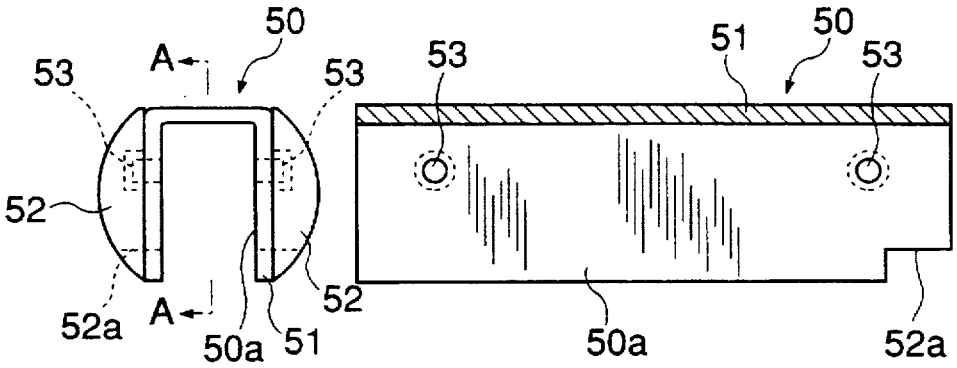
FIGS. 2A and 2B are views showing the FIG. 1 guide member in its assembled state.
Figure 4:
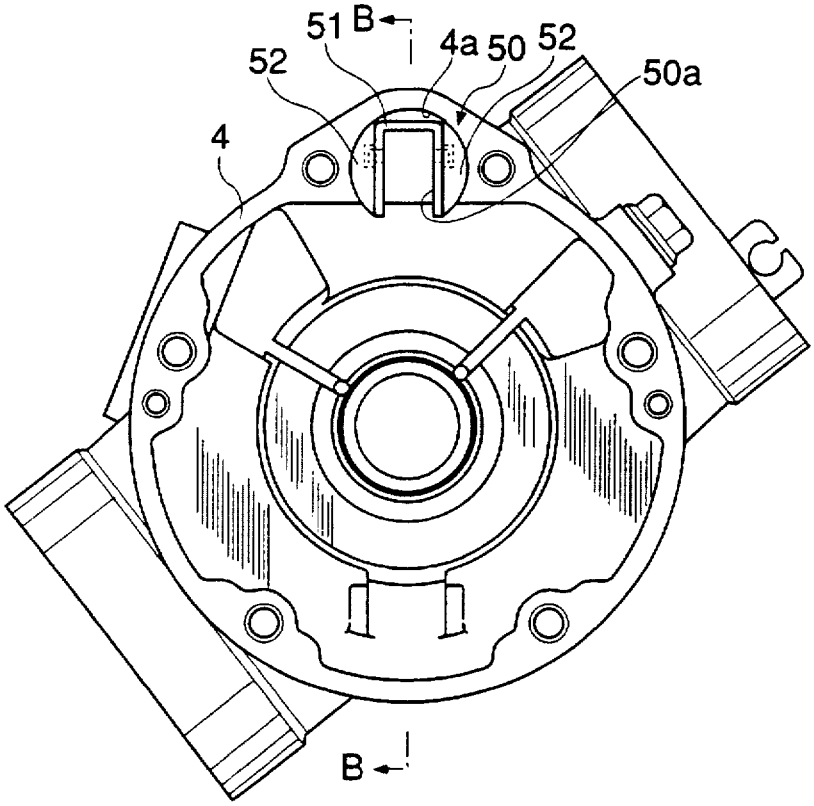
FIG. 4 is a view of the interior of a front head as viewed from a cylinder block side.
Figure 5:
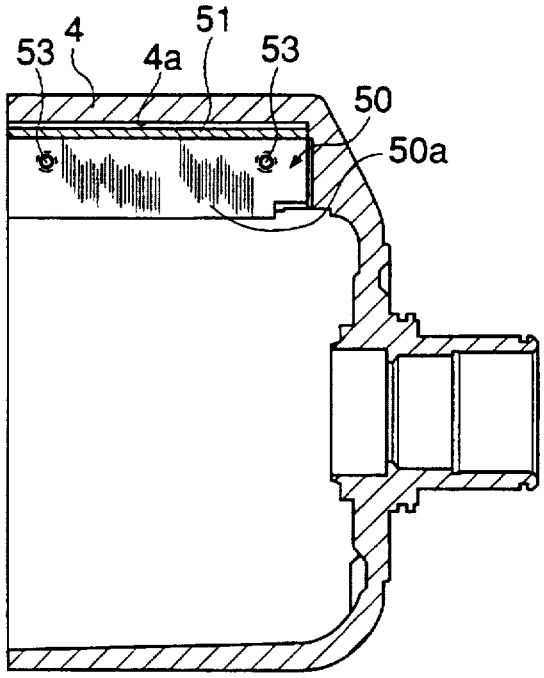
FIG. 5 is a cross-sectional view taken on line B—B of FIG. 4.

FIG. 1 shows, in perspective, the guide member 50 in its exploded state. FIG. 2A shows and end face of the guide member 50 in its assembled state, while FIG. 2B is a cross-sectional view of the guide members taken on line A—A of FIG. 2A. FIG. 4 shows the interior of the front head 4 as viewed from a cylinder block side, and FIG. 5 is a cross-sectional view of the guide member taken on line B—B of FIG. 4.

The guide member 50 is comprised of guide means 51 formed by pressing a flat plate e.g. of a metal into a shape having a U-shaped cross-section such that the linear guide groove 50*a* is formed therein, and a pair of sliding members 52 removably mounted on respective outer opposite side faces of the guide means 51 for sliding on the inner wall surfaces of a mounting groove 4*a* formed in the front head 4. The guide means 51 has surfaces thereof subjected to a surface treatment, such as nitriding treatment, for enhanced surface hardness thereof. The guide means 51 has each of the outer opposite side faces thereof formed with projections 53. The sliding means 52 has a shape similar to that of a half cylinder and has a flat joining surface 52*b* thereof formed with holes 54 for having respective corresponding ones of the projections 53 fitted therein. The guide means 51 has each side wall formed with a relief 51*a* at an open end face at one end thereof, to avoid interference with a rotation sensor, not shown, and the sliding means 52 are also each formed with a relief 52*a* at one end thereof to avoid interference with the rotation sensor.

The guide member 50 in its assembled state is fit in the mounting groove 4*a* formed in the inner surface of the front head 4, such that it can be rotated about an imaginary axis parallel to the shaft 5. The slipper 36 is inserted into the linear guide groove 50*a* of the guide member 50 arranged parallel to the shaft 5, thereby preventing the wobble plate 10 from rotating about the drive shaft.

With rotation of the shaft 5, the thrust flange 40 and the drive hub 41 rotate in unison therewith, whereby as the drive hub 41 rotates, the wobble plate 10 performs wobbling motion about the hinge ball 9. The wobbling motion of the wobble plate 10 is transmitted via the connecting rod 11 to the piston 7, thereby transforming the wobbling motion of the wobble plate 10 into a linear reciprocating motion of the piston 7. Since the slipper 36 mounted on the head of the restraint pin 35 is inserted into the linear guide groove 50*a* of the guide member 50, the rotation of the wobble plate 10 is prevented.

In the wobble plate compressor, as pressure within the crank case 8 decreases, the inclination angle of the wobble plate 10 increases as shown in FIG. 3, which brings the piston 7 to its maximum stroke, whereby the compressor is placed into the maximum delivery quantity condition.

On the other hand, as the pressure within the crank case 8 increases, the inclination angle of the wobble plate 10 decreases, and one end of the drive hub 41 becomes away from the thrust flange 40, which brings the piston 7 to its minimum stroke, whereby the compressor is placed into the minimum delivery quantity condition.

When the compressor is operating in the maximum delivery quantity condition, the slipper 36 largely slides within the linear guide groove 50*a*, as shown in FIG. 3.

According to the guide member 50 of the present embodiment, several forms of sliding means 52 having different values of a thickness a indicated in FIG. 1 can be prepared in advance, and a pair of suitable ones can be selected therefrom. The elastic deformation of the guide means 51 occurring when the guide member 50 is fit in the mounting groove 4*a* changes a width d of an entrance of the linear guide groove 50*a* in a manner corresponding to the thickness a of each sliding means 52, whereby space between the inner wall surfaces of the guide means 51 and the slipper 36 can be adjusted to the optimum value. This makes it possible to obtain accurate dimensions of the guide member 50 with ease, which contributes to reduction of manufacturing cost of the compressor.

Further, since suitable pairs of the sliding means 52 can be selected for use to obtain accurate dimensions of the guide member 50, it is not necessary to machine the guide means 51 and the sliding means 52 with a very high accuracy, which contributes to reduction of manufacturing cost.

Further, since it is only required to subject the guide means 51 alone to surface treatment for obtaining high surface hardness, it is possible to reduce the cost of this surface treatment.

Figure 6:
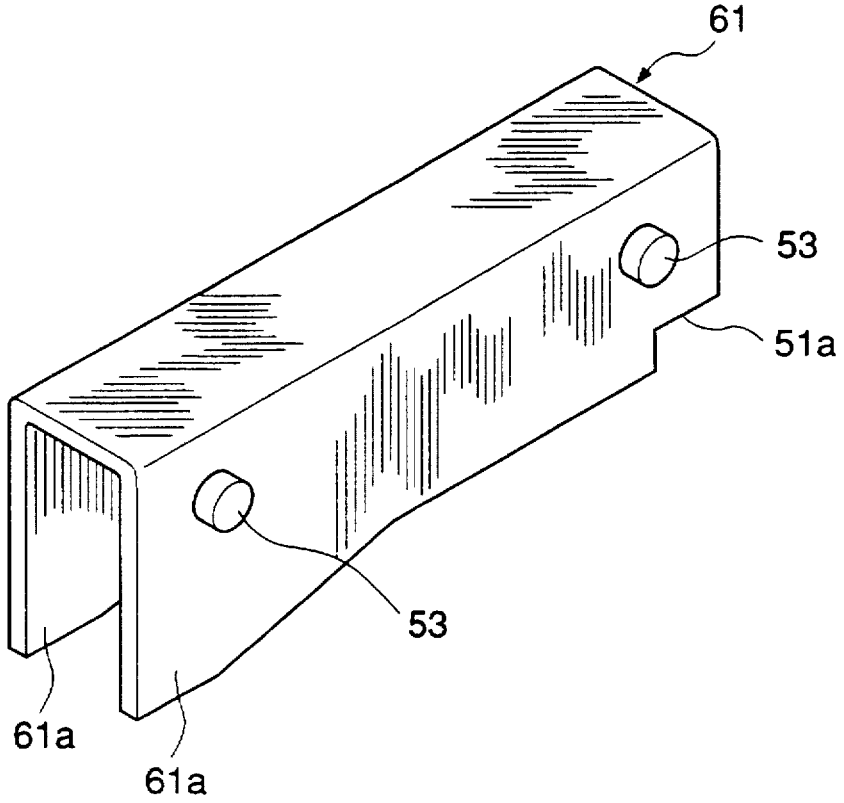
FIG. 6 is a perspective view showing guide means of a guide member of a wobble plate compressor according to the other embodiment of the invention.
Figure 7:
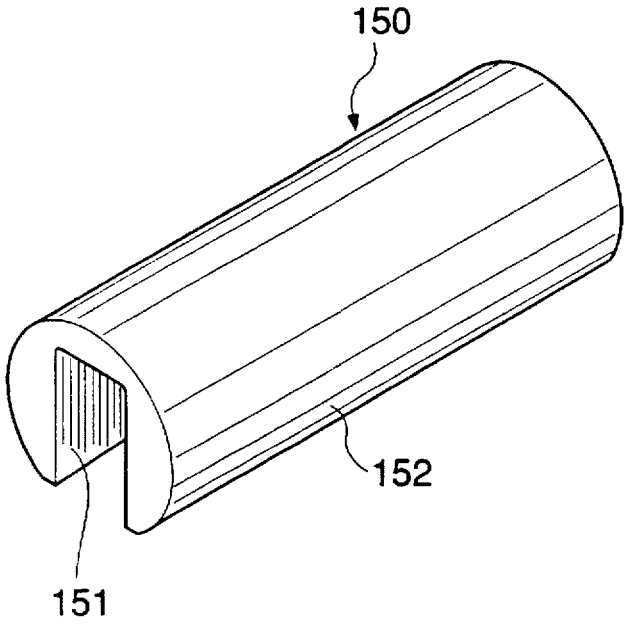
FIG. 7 is a perspective view of a guide member of a conventional wobble plate compressor.
Figure 8A:
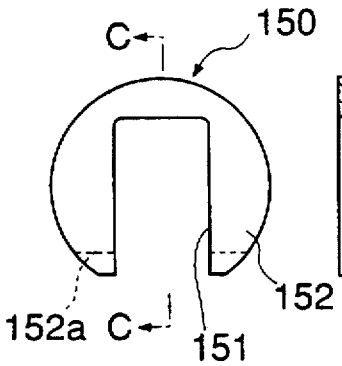
FIGS. 8A and 8B are views showing the FIG. 7 guide member.
Figure 8B:
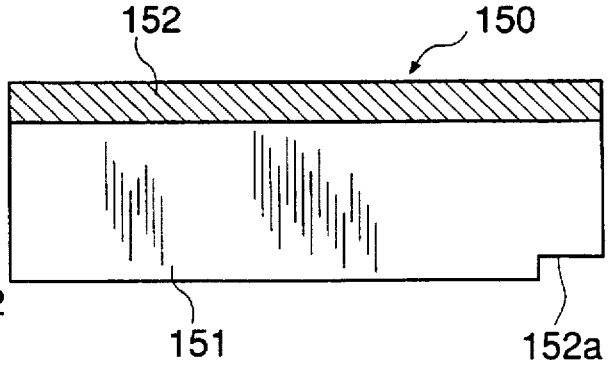
Figure 9:
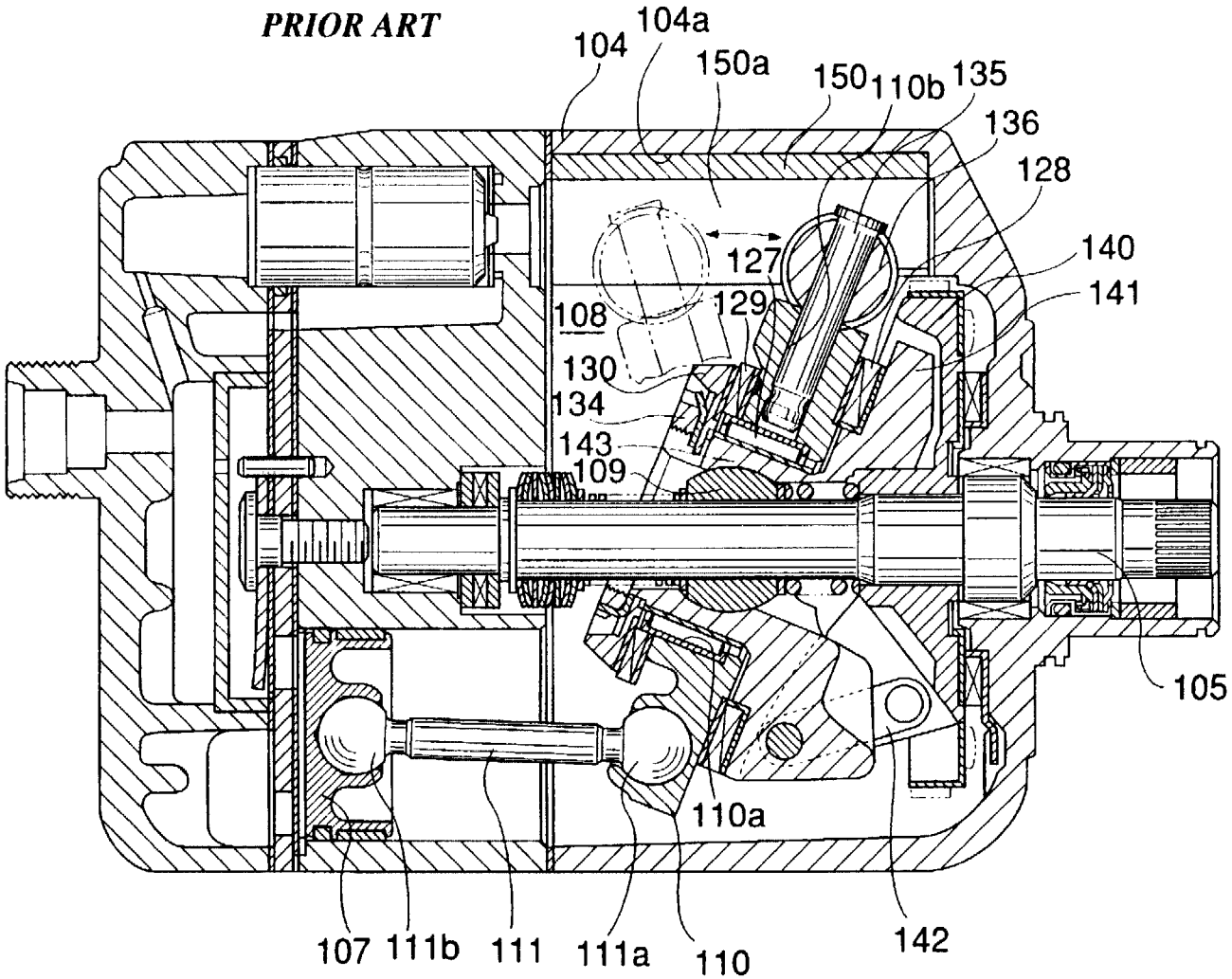
FIG. 9 PRIOR ART
FIG. 9 is a longitudinal cross-sectional view showing the whole arrangement of the conventional wobble plate compressor.
Figure 10:
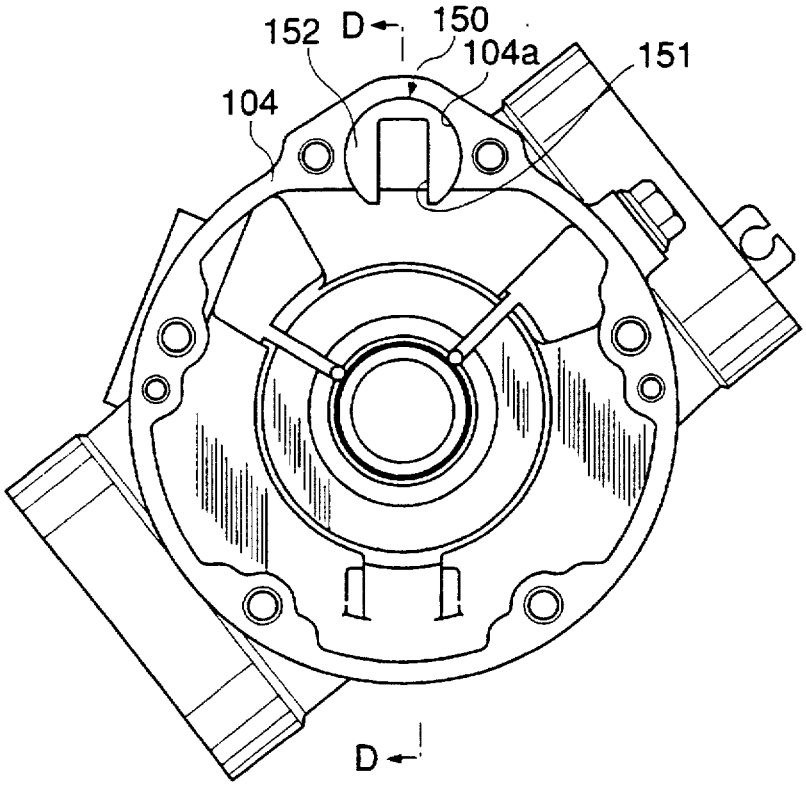
FIG.10 PRIOR ART
FIG. 10 is a view of the interior of a front head of the conventional wobble plate compressor as viewed from a cylinder block side.
Figure 11:
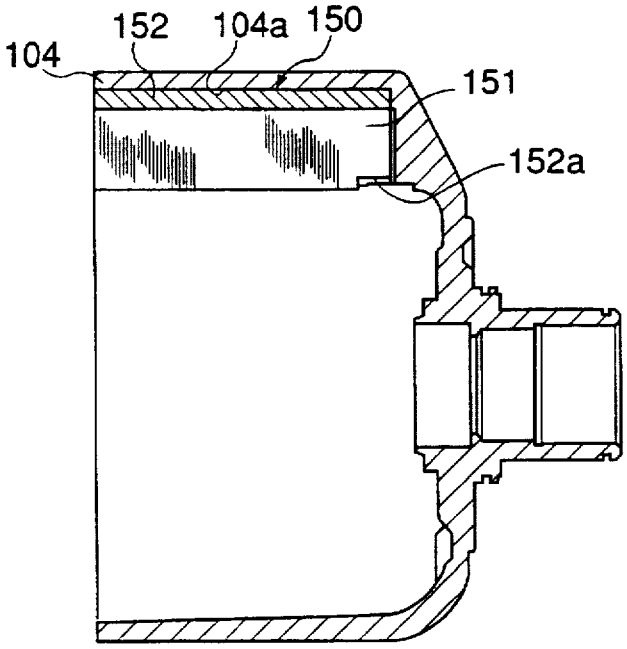
FIG.11 PRIOR ART
FIG. 11 is a cross-sectional view taken on line D—D of FIG. 10.
Figure 1:
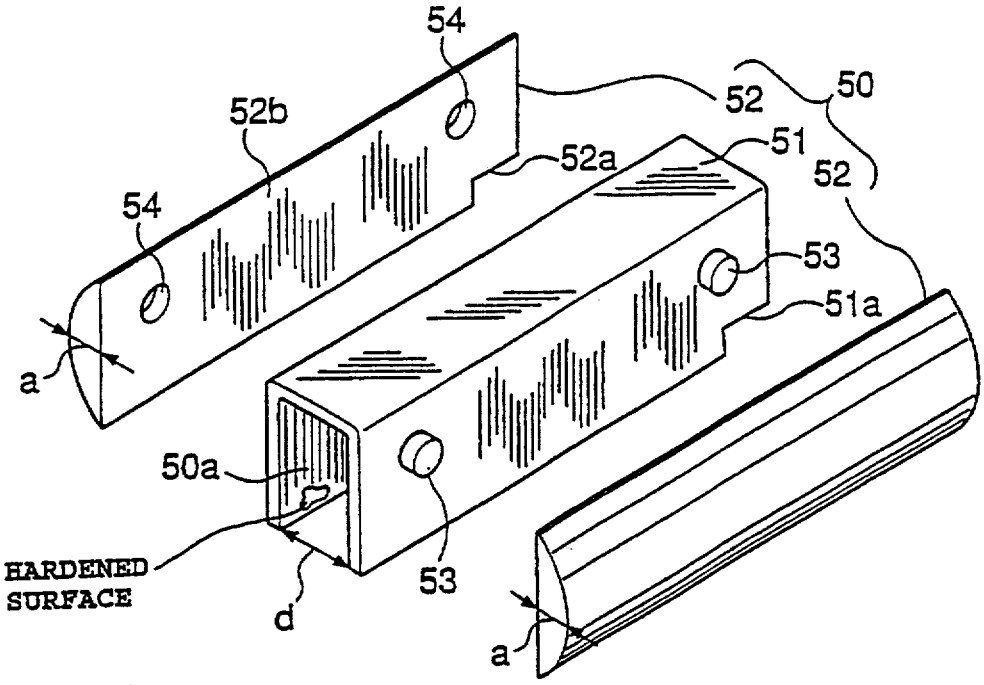
Figure 2A:
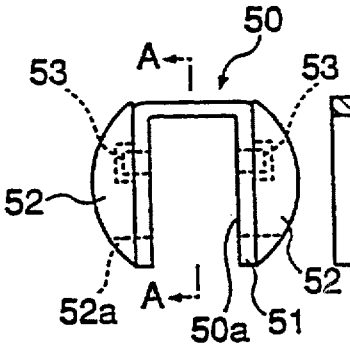
Figure 2B:
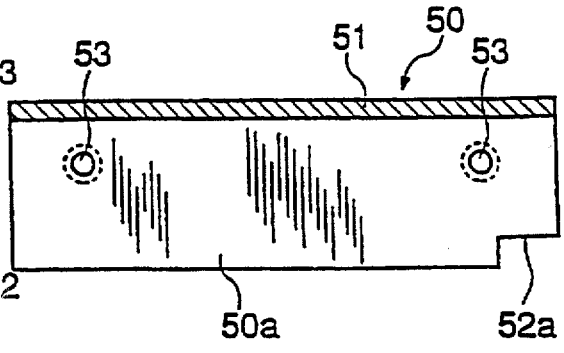

FIG. 6 shows, in perspective, guide means of a guide member of a wobble plate compressor according to another embodiment of the invention. In this embodiment illustrated in FIG. 6, portions corresponding to those of the first-described embodiment are designated by identical reference numerals and detailed description thereof is omitted.

This embodiment is distinguished from the first-described embodiment, in which the guide means 51 is formed by pressing a simple rectangular plate into a shape having a U-shaped cross-section, that an extension portion 61*a* is integrally formed with each side wall of the guide means 61 such that the extension portion 61*a* extends toward the drive shaft (in a state of the guide member 50 being mounted in the mounting groove 4a of the front head 4), i.e. downward as viewed from FIG. 6, according to a path of the slipper 36.

According to this embodiment, it is possible to preserve a constant value of a contact area between the guide means 61 and the slipper 36, which improves sliding characteristics of the slipper 36 on the guide means 61.

What is claimed is:

1. In a wobble plate compressor including a housing, a drive shaft, a wobble plate mounted on said drive shaft for performing wobbling motion according to rotation of said drive shaft, a guide member slidably mounted in an inner wall surface of said housing such that said guide member is rotatable about an axis parallel to said drive shaft, said guide member being formed with a linear guide groove extending in parallel with said drive shaft, and a rotation-preventing member rigidly mounted on said wobble plate and slidably inserted into said linear guide groove of said guide member for preventing rotation of said wobble plate, the improvement wherein said guide member comprising:

guide means having a U-shaped cross-section and defining said linear guide groove therein; and a pair of sliding means mounted on opposite sides of said guide means for sliding on said inner wall surface of said housing.

2. A wobble plate compressor according to claim 1, wherein said guide means is formed by pressing a plate into a shape having said U-shaped cross-section.

3. A wobble plate compressor according to claim 2, wherein each of said side walls of said guide means has an outer surface thereof formed with projections, and wherein each of said pair of sliding means has an inner surface thereof formed with holes, said holes being fitted on said projections on said outer surface of said each of said side walls of said guide means, whereby said pair of sliding means are fixed to said side walls of said guide means, respectively.

4. A wobble plate compressor according to claim 2, wherein said guide means has side walls defining said linear guide groove therebetween, said side walls each having an extension portion integrally formed therewith such that said extension portion extends toward said drive shaft according to a path of said rotation-preventing member.

5. A wobble plate compressor according to claim 2, wherein said guide means has a surface with a surface hardness enhanced by surface treatment.

6. A wobble plate compressor according to claim 2, wherein each of said pair of sliding means having a shape similar to that of a half cylinder.

7. A wobble plate compressor according to claim 1 wherein said guide means has side walls defining said linear guide groove therebetween, said side walls each having an extension portion integrally formed therewith such that said extension portion extends toward said drive shaft according to a path of said rotation-preventing member.

8. A wobble plate compressor according to claim 1 wherein said guide means has a surface with a surface hardness enhanced by surface treatment.

9. A wobble plate compressor according to claim 1 wherein each of said pair of sliding means having a shape similar to that of a half cylinder.

* * * * *

UNITED STATES PATENT AND TRADEMARK OFFICE

CERTIFICATE OF CORRECTION

PATENT NO. :5,839,347

DATED :November 24, 1998

INVENTOR(S) :Hiroshi NOMURA ET AL.

It is certified that error appears in the above-identified patent and that said Letters Patent is hereby corrected as shown below:

In the drawings

Replace the sheets of drawings containing

Figs 1, 7, 8A and 8B with the sheets attached.

Signed and Sealed this

Twenty-fifth Day of January, 2000

*Attest:*

*Attesting Officer*

*Acting Commissioner of Patents and Trademarks*